US010617939B2

(12) United States Patent
Tsai

(10) Patent No.: US 10,617,939 B2
(45) Date of Patent: Apr. 14, 2020

(54) ADJUSTABLE TABLETOP SPORTS GOAL

(71) Applicant: Medal Sports (Taiwan) Corporation, Taipei (TW)

(72) Inventor: Kevin Chunhao Tsai, Kaohsiung (TW)

(73) Assignee: Medal Sports (Taiwan) Corporation, Taipei (TW)

( * ) Notice: Subject to any disclaimer, the term of this patent is extended or adjusted under 35 U.S.C. 154(b) by 0 days.

(21) Appl. No.: 15/665,846

(22) Filed: Aug. 1, 2017

(65) Prior Publication Data

US 2019/0038949 A1 Feb. 7, 2019

(51) Int. Cl.

| | |
|---|---|
| ***A63F 7/06*** | (2006.01) |
| ***A63F 7/30*** | (2006.01) |
| ***A63F 7/00*** | (2006.01) |
| ***A63F 7/07*** | (2006.01) |
| ***A63B 71/06*** | (2006.01) |
| ***A63F 11/00*** | (2006.01) |
| *A63B 63/00* | (2006.01) |

(52) U.S. Cl.

CPC ..... *A63F 7/06* (2013.01); *A63B 71/0672* (2013.01); *A63F 7/0017* (2013.01); *A63F 7/066* (2013.01); *A63F 7/0672* (2013.01); *A63F 7/07* (2013.01); *A63F 7/305* (2013.01); *A63F 7/306* (2013.01); *A63F 11/0051* (2013.01); *A63B 63/00* (2013.01)

(58) Field of Classification Search

CPC ..... A63B 2063/002; A63D 15/003; A63D 15/04; A63F 7/0005–2007/0011; A63F 7/0017–2007/0052; A63F 7/06–7/0672; A63F 2007/007; A63F 2007/303; A63F 2007/3611

USPC ..... 273/108.1, 108.4, 108.5, 108.52, 108.54; 473/14, 28; 248/295.11, 295.31, 297.31, 248/476–477; 220/481; 222/561

See application file for complete search history.

(56) References Cited

U.S. PATENT DOCUMENTS

| | | | | |
|---|---|---|---|---|
| 1,630,538 A * | 5/1927 | Micallef | F24B 15/04 | 222/561 |
| 2,045,460 A * | 6/1936 | Goewey | A63B 67/04 | 473/435 |
| 2,777,608 A * | 1/1957 | Sheffler | B65D 25/48 | 222/545 |
| 3,871,655 A * | 3/1975 | Zimmers | A63D 15/04 | 108/150 |
| 4,034,978 A * | 7/1977 | Becker | A63B 63/00 | 473/416 |
| 4,280,640 A * | 7/1981 | Daloisio | B29C 33/0033 | 220/1.5 |
| 6,347,797 B1 * | 2/2002 | Tsai | A63D 15/04 | 273/309 |

(Continued)

*Primary Examiner* — Laura Davison

(74) *Attorney, Agent, or Firm* — Honigman LLP

(57) ABSTRACT

The present disclosure provides a goal secured to a table configured to receive a projectile from a tabletop game with a playing surface. The goal includes a net portion, at least one bracket, and a tray portion. The net portion has a first end and a second end. The net portion is movable between a first position and a second position. The net portion is configured to receive a first projectile in the first position and a second projectile in the second position. The at least one bracket is configured to receive at least one of the first end or the second end of the net portion. The tray portion is configured to store the first projectile and the second projectile.

11 Claims, 9 Drawing Sheets

(56) References Cited

U.S. PATENT DOCUMENTS

| | | | | |
|---|---|---|---|---|
| 6,349,939 | B1 * | 2/2002 | Tsai | A63D 15/04 273/108.1 |
| 7,178,802 | B2 * | 2/2007 | Nally | A63F 7/305 273/108 |
| 7,484,733 | B2 * | 2/2009 | Lowrance | A63F 9/305 273/343 |
| 9,011,262 | B2 * | 4/2015 | Peng | A63D 15/003 473/28 |
| 9,468,840 | B2 * | 10/2016 | Nally | A63F 7/0612 |
| 9,844,721 | B2 * | 12/2017 | Pavey | A63F 7/06 |
| 2007/0216101 | A1 * | 9/2007 | Padilla | A63B 67/04 273/309 |

* cited by examiner

ADJUSTABLE TABLETOP SPORTS GOAL

TECHNICAL FIELD

This disclosure relates to systems and methods of adjusting a tabletop sports goal.

BACKGROUND

Traditionally, game tables are structurally limited to a configuration for a particular game. Often a limiting factor is the scoring configuration required to play certain games. To name some examples: pool tables have pockets; air hockey tables have low profile goals for a low profile hockey puck; foosball tables have soccer-like goal; table hockey has miniature hockey goals on the surface of the table; and ping-pong only requires a net on the game table. Due to these different needs, game tables are commonly stand-alone tables limited to a particular game where a user would be unable to play other kinds of games on that particular table. Accordingly, to play more than one kind of game may require the user to have more than one game table. Unfortunately, the footprint of each additional game table may consume valuable floor space.

To overcome some of these setbacks, game table manufacturers began offering multi-game tables. A multi-game table is a modular design where the user may change a top surface panel of the table to play other games on the same table. In other words, the multi-game table is limited to tabletop games of a similar size top surface panel. Although these multi-game tables reduced the requirement for an individual table for each table game, multi-game tables suffer from still other setbacks including the need for each tabletop game within a multi-game table to include its own goal or scoring components. By needing each tabletop game to have its own goal or scoring components, the user may more easily break, misplace, or encounter issues setting up each tabletop game of the multi-game table. For these reasons, there is a continuing need of improvement for table games.

SUMMARY

One aspect of the disclosure provides a goal secured to a table configured to receive a projectile from a tabletop game with a playing surface. The goal includes a net portion, at least one bracket, and a tray portion. The net portion has a first end and a second end. The net portion is movable between a first position and a second position. The net portion is configured to receive a first projectile in the first position and a second projectile in the second position. The at least one bracket is configured to receive at least one of the first end or the second end of the net portion. The tray portion is configured to store the first projectile and the second projectile.

Implementations of the disclosure may include one or more of the following optional features. In some implementations, the net portion has a top net surface that is substantially flush with a top surface of the table in the first position. In some examples, the net portion has a scoreboard. In some configurations, the tray portion has a top tray surface facing the net portion and at least one sidewall. In these configurations, the at least one sidewall extends from the top tray surface toward the net portion such that the extension of the at least one sidewall defines a lip to retain the first projectile and the second projectile for storage. The at least one bracket may have a channel configured to receive the at least one end of the net portion. The tray portion may have an end stop configured to receive the net portion in the first position. In some examples, a space between the tray portion and the net portion defines an opening to remove the first projectile and the second projectile from the tray portion.

In some implementations, the goal further includes at least one retaining device to secure the net portion in at least one of the first position or the second position. The at least one retaining device may be a magnet, a mechanical stop, or a friction fit between the net portion or the at least one bracket.

In some examples, the net portion has a top net surface. The top net surface may define a net opening extending between the playing surface and the top net surface of the net portion. In the first position, the net opening may have a first position height extending between the playing surface and the top net surface of the net portion. In the second position, the net opening may have a second position height extending between the playing surface and the top net surface of the net portion. The first position height may be less than the second position height.

Optionally, the net opening has a top net surface and a cross sectional area. The cross sectional area may be defined by a width of the net portion and a height of the net portion. Here, the width of the net portion extends between the first end and the second end and the height of the net portion extends between the playing surface and the top net surface of the net portion. In some examples, the cross sectional area is greater when the net portion is in the second position than when the net portion is in the first position.

In some examples, the goal has a first bracket and a second bracket. In these examples, the first bracket is configured to receive the first end of the net portion and the second bracket is configured to receive the second end of the net portion. The net portion may include at least one flange extending from at least one of the first end or the second end. The at least one flange may be received by the at least one bracket.

Another aspect of the disclosure provides a goal configured to receive a projectile. The goal has a table, a net portion, at least one bracket, and a tray portion. The table has a first tabletop game with a first playing surface. The net portion has a first end and a second end. The net portion is moveable between a first position and a second position. The net portion is configured to receive a first projectile in the first position and a second projectile in the second position. The at least one bracket is configured to receive at least one of the first end or the second end of the net portion. The tray portion is disposed beneath the net portion. The tray portion is configured to store the first projectile and the second projectile. At least one of the net portion, the at least one bracket, or the tray portion is secured to the table.

This aspect may include one or more of the following optional features. The table may include a second tabletop game disposed on the first playing surface. The first tabletop game may be air hockey and the second tabletop game may be foosball. The second tabletop game may have an opening to receive the goal wherein the net portion substantially encloses the opening in the second position. The second tabletop game may include at least one retaining device to secure the net portion in the second position.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
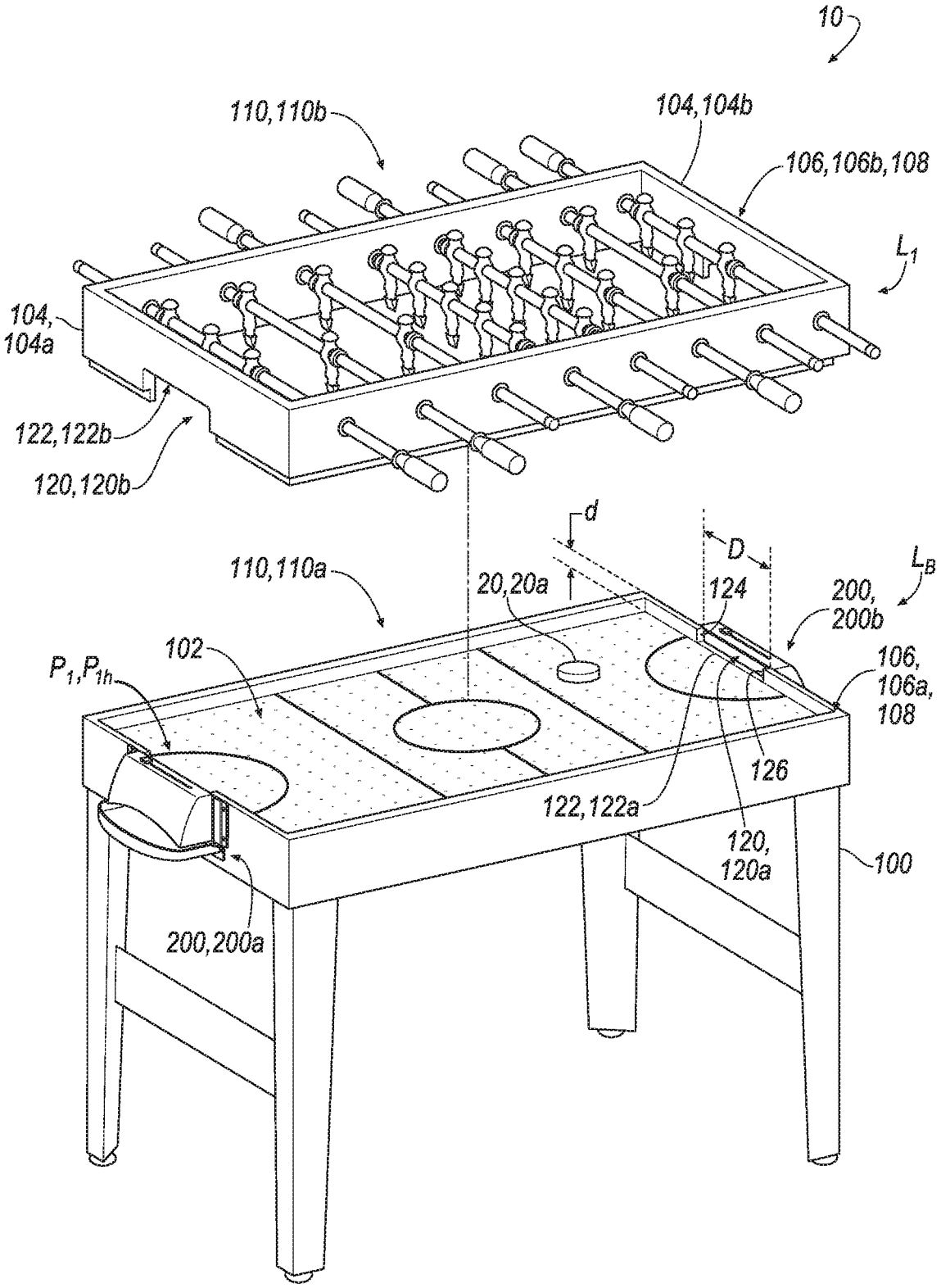
FIG. 1A is an exploded view of an example tabletop game table.
Figure 1B:
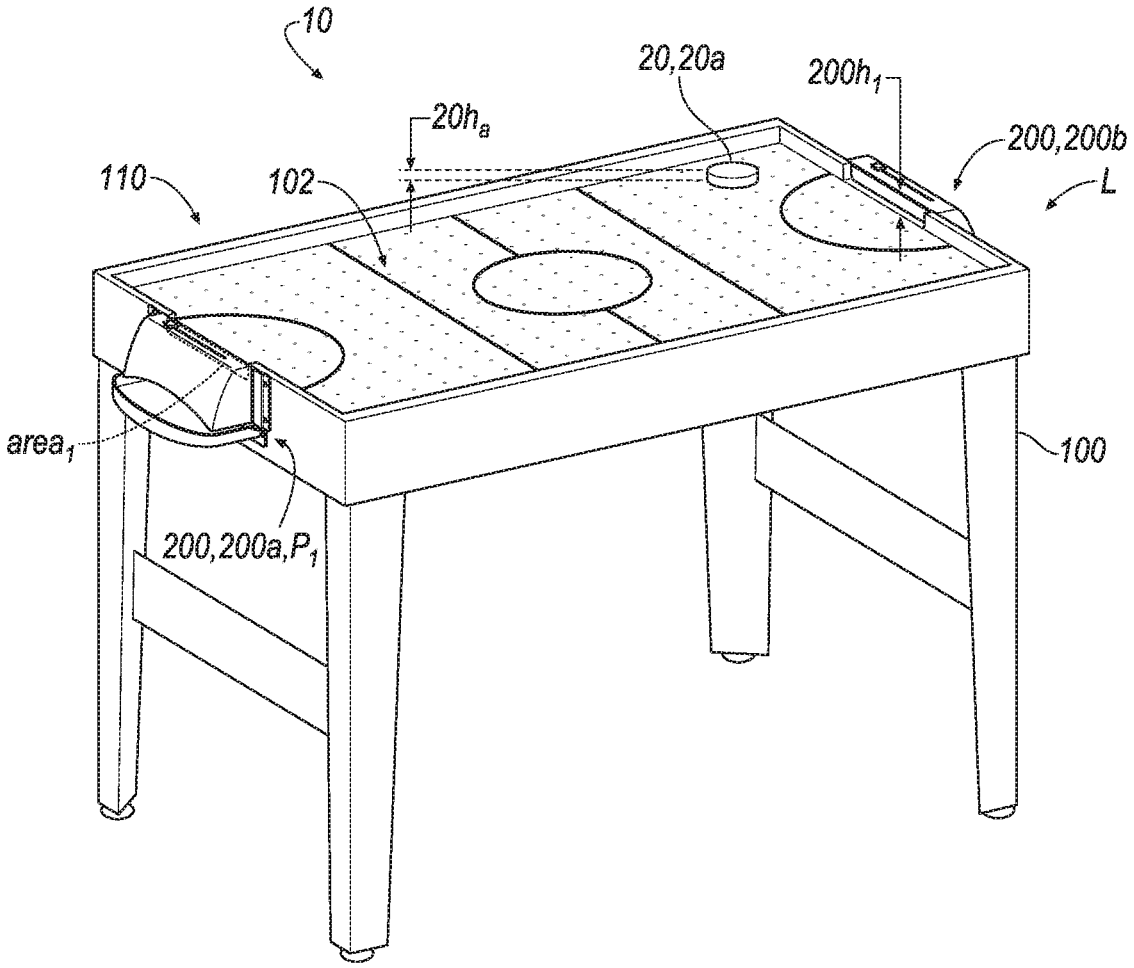
FIG. 1B is a isometric view of an example tabletop game.
Figure 1C:
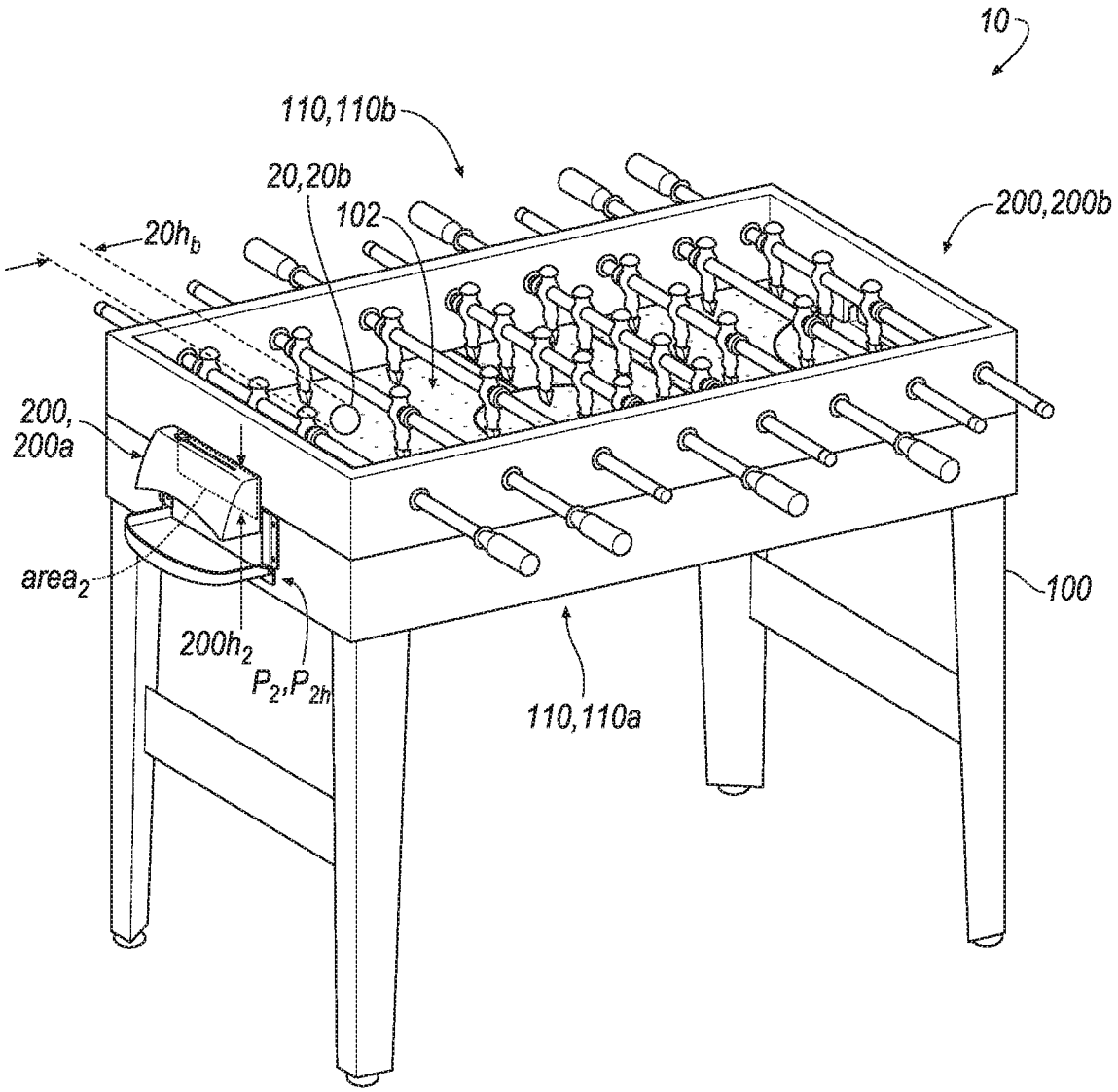
FIG. 1C is a isometric view of an example tabletop game.

FIGS. 1A-1C are examples of a tabletop game environment 10. Generally, a tabletop game 110 is a game played within a confined space of a table 100. Examples of tabletop games include foosball (or table football/soccer), air hockey, pool (pocket billiards), bumper pool, carom billiards, table hockey (rod hockey), NOK hockey, shuffleboard, ping-pong, chess, checkers, backgammon, or other versions of entertainment games that may be confined to a table. The tabletop game environment 10 includes a table 100 with at least one playing surface 102 corresponding to at least one tabletop game 110. The tabletop game environment 10 may include one tabletop game 110 (e.g., FIG. 1B) or more than one tabletop game 110. For example, FIGS. 1A and 1C depict a first tabletop game 110, 110*a* and a second tabletop game 110, 110*b*.

Typically, the table 100 includes the playing surface 102, at least one goal end 104, and a top surface 106. The playing surface 102 is generally an area for playing the tabletop game 110 on a top surface of the table 100. Often, the playing surface 102 is substantially parallel to a ground plane, but, in some configurations, the playing surface 102 may be angled or sloped with reference to the ground plane to accommodate the tabletop game 110. In some examples, the table 100 includes a first goal end 104, 104*a* and a second goal end 104, 104*b*. At the at least one goal end 104, the table 100 includes at least one goal 200 secured to the table 100 anywhere along the at least one goal end 104. Although, the at least one goal 200 may be secured at any position along the at least one goal end 104, many tabletop games 110 have the at least one goal 200 secured to the table 100 at a midpoint along the at least one goal end 104. For example, FIGS. 1A-1C depict the table 100 with the goal 200 mounted at the midpoint of the at least one goal end 104 on a surface of a box frame containing the playing surface 102.

Figure 2A:
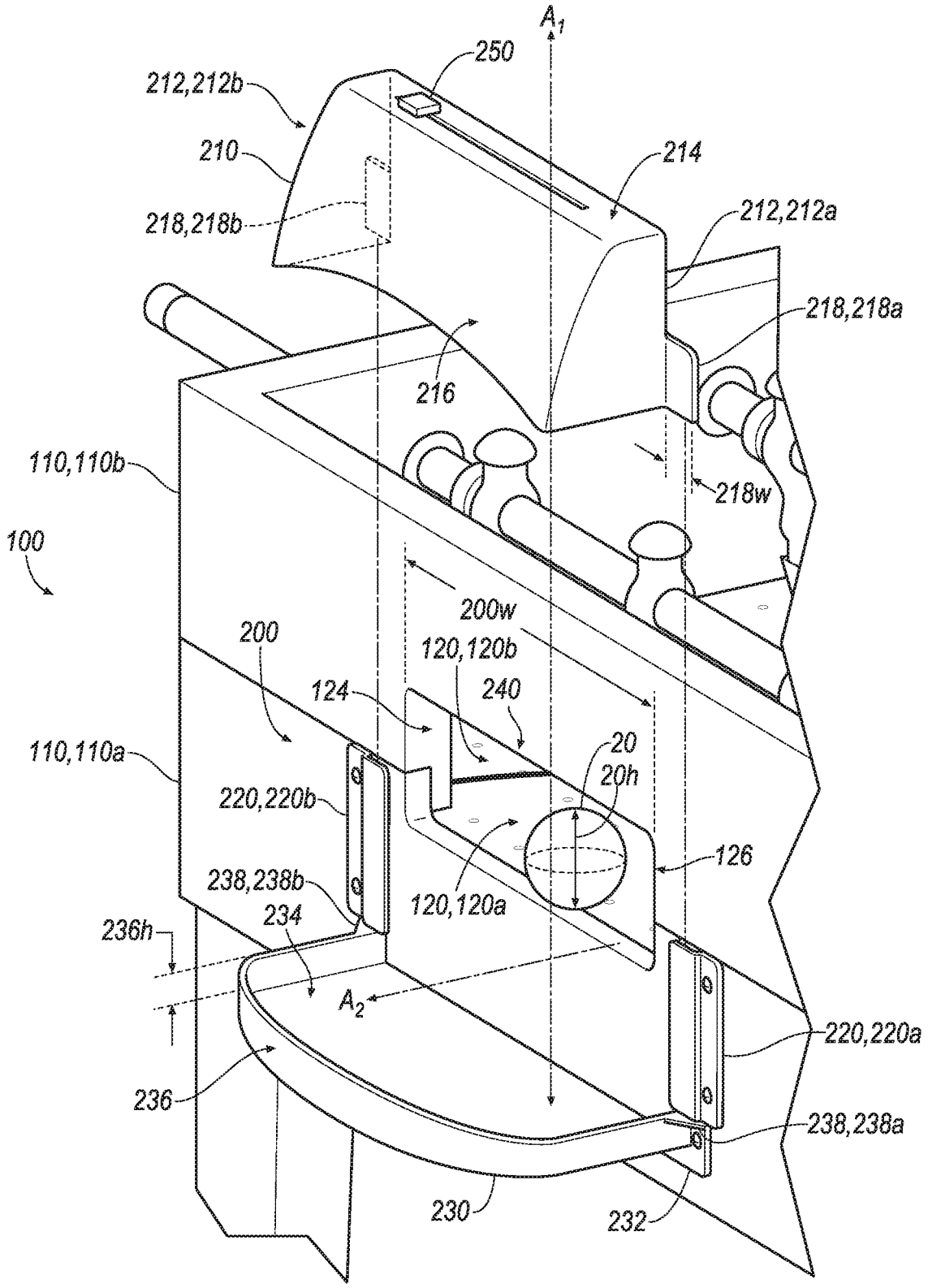
FIG. 2A is an exploded view of an example goal portion of a tabletop game table.

In some implementations, the table 100 or the tabletop game 110 includes an opening 120 perpendicular to the playing surface 102. The opening 120 has a base 122 that may form a bottom of the goal 200 (e.g., the base 122, 122*a* of the tabletop game 110, 110*a* of FIG. 1A) or a top of the goal 200 (e.g., the base 122, 122*b* of the tabletop game 110, 110*b* of FIG. 1A). In some examples, the base 122 (e.g., the base 122, 122*a*) is generally flush with the playing surface 102 to enable smooth travel of a projectile 20 into the goal 200. The opening 120 may be a cutaway a depth "d" from the top surface 106 of the table 100 (e.g., tabletop game 110, 110*a* of FIG. 1A). Additionally or alternatively, the opening 120 (the opening 120, 120*b*) is a cutaway extending from where a top surface 106, 106*a* of the first tabletop game 110, 110*a* mates with the second tabletop game 110, 110*b* towards the top surface 106, 106*b* of the second tabletop game 110, 110*b*. The opening 120 also includes two sides 124, 126 defining edges of the goal 200 (e.g., a near post and a far post). With the base 122 and two sides 124, 126, the opening 120, at least partially, defines an entrance of the goal 200. In some implementations, a distance "D" between the sides 124 and 126 corresponds to a width 200*w* of the goal 200 (FIG. 2A). In some examples, each of the sides 124, 126 extend to meet the goal 200 in a first position $P_1$. As an example, each of the sides 124, 126 extend to the top surface 106 of the table 100 (e.g., the top surface 106, 106*a* of the first tabletop game 110, 110*a*). In some examples, the top surface 106 of the table 100 may be flush with the playing surface 102 (e.g., in a ping-pong tabletop game) or extend above the playing surface 102 to form a perimeter side wall 108 around the playing surface 102. For example, in FIG. 1A, the cutaway depth d of the opening 120, 120*a* is substantially equal to a height of the perimeter side wall 108 measured from the playing surface 102 at the at least one goal end 104. When the top surface 106 is flush with the playing surface 102, the goal 200 may be a goal height 200*h* above the playing surface 102 in the first position $P_1$ (not shown). Whereas, when the top surface 106 extends above the playing surface 102, the goal 200 may be flush with the top surface 106 in the first position $P_1$. In the case where the top surface 106 extends above the playing surface 102, the perimeter side wall 108 forms a barrier to retain the projectile 20 on the playing surface 102 during play of the tabletop game 110. In some examples, the tabletop game 110 (e.g., the second tabletop game 110, 110*b*) may redefine the top surface 106 of the table 100 (e.g., the top surface 106, 106*b*) and may extend a height of the perimeter side wall (e.g., the tabletop game 110, 110*b*). In examples with more than one tabletop game 110, the user may remove, exchange, or stack the playing surface 102 to change the tabletop game 110 such that different playing surfaces 102 or different combinations of playing surfaces 102 may be seated within the perimeter side wall 108 or on top of the table 100.

As illustrated by FIGS. 1A-1C, the table 100 includes the goal 200 secured to the table 100 as a component of at least one tabletop game 110. The goal 200 is configured to receive the projectile 20 corresponding to the at least one tabletop game 110. The projectile 20 is any three-dimensional object used as a component of the at least one tabletop game 110. Generally, the projectile 20 is used as a means of scoring or advancing the tabletop game 110 towards victory. The goal 200 may have dimensions relating to the projectile 20 corresponding to the at least one tabletop game 110. To depict how the goal 200 is multifunctional as the goal 200 moves between the first position $P_1$ and the second position $P_2$, FIGS. 1A-1C depict a first projectile 20, 20*a* and a second projectile 20, 20*b*. In these examples, the first projectile 20, 20*a* is a proportional hockey puck corresponding to the first tabletop game 110, 110*a* of air hockey (e.g., FIGS. 1A and 1B). Similarly, in these examples, the second projectile 20, 20*b* is a proportional soccer ball corresponding to the second tabletop game 110, 110*b* of foosball (e.g., FIG. 1C). The goal 200 may be offset at a goal height 200*h* from the playing surface 102 such that the goal height 200*h* is greater than a height 20*h* of the projectile 20. For example, in the case of air hockey, the proportional hockey puck (depicted as the first projectile 20, 20*a*) may have a height

20$h_a$ of about ¼" and thus the goal height 200*h* is greater than ¼." In the case of foosball, the proportional soccer ball (depicted as the second projectile 20, 20*b*) may have a height 20$h_b$ of about 1¼"-1½" and the goal height 200*h* is greater than this range of 1¼"-1½."

FIG. 1A illustrates an example tabletop game environment 10 with more than one tabletop game 110, 110*a-b* as the at least one tabletop game 110. The tabletop game environment 10 of FIG. 1A is a modular design where the table 100 is configured to convert between different tabletop games (e.g., tabletop games 110, 110*a-b*) depending on which tabletop game 110 a user wishes to play. In other words, the table 100 includes different combinations of tabletop game layers L. For example, FIG. 1A depicts the table 100 with the first tabletop game 110, 110*a* (e.g., shown as air hockey) and the second tabletop game 110, 110*b* (e.g., shown as foosball) as a base layer $L_B$ and a first layer $L_1$ respectfully. In this example, the table 100 is configured to receive the second tabletop game 110, 110*b* on top of the first tabletop game 110, 110*a*, such that the second tabletop game 110, 110*b* mates with features of the table 100 and/or features of the first tabletop game 110, 110*a* below the second tabletop game 110, 110*b*. For example, joinery techniques (e.g., rabbets, tongue and groove, mortise and tenon, doll pins, etc.), fasteners, pressure fits, or any mating combination may combine each layer L of the tabletop games 110 (e.g., the first tabletop game 110, 110*a* and the second tabletop game 110, 110*b*) together to permit the modular (or nested) design of the table 100.

The modular design for tabletop games 110 provides space savings such that a user may not need to have multiple tables 100 or may consolidate multiple tables 100 into one modular design. The modular design also allows users to have more gaming options as many different tabletop game 110 configurations and combinations are possible. As an example, if the tabletop game environment 10 of FIG. 1A included a third tabletop game 110, 110*c*, such as ping-pong, a ping-pong tabletop game may be best played at a particular playing height such that a ping-pong tabletop game may be best played as a second layer $L_2$ on some tables 100 or, depending on the combination of layers L, a different layer, such as a third layer $L_3$ or fourth layer $L_4$ on other tables 100. Different manufacturers may recommend different orders to tabletop games 110 of a table 100 or construct a table 100 such that tabletop games 110 only fit together in a particular manner to optimize (or comply with rules related to) a particular tabletop game 110.

Referring further to FIG. 1A, the first tabletop game 110, 110*a* includes the playing surface 102 corresponding to a field of play of at least the first tabletop game 110, 110*a*. As depicted in FIG. 1A, the second tabletop game 110, 110*b* shares the playing surface 102. In other examples, however, the second table game 110, 110*b* includes a different playing surface 102 related to the second table game 110, 110*b* as compared to a playing surface 102 of the first tabletop game 110, 110*a*. For example, the first tabletop game 110, 110*a*, as air hockey, may have a playing surface 102 designed for air hockey (e.g., having air holes and lines corresponding to a hockey rink). Whereas, the second tabletop game 110, 110*b*, as foosball, may have a playing surface 102 with lines corresponding to a soccer field. If a third layer L3, such as a ping-pong layer, was included as a layer L, the ping-pong tabletop game layer would need a playing surface 102 corresponding to a ping-pong table to cover the example of the second tabletop game 110, 110*b* which has an open top for foosball.

FIG. 1B is another example of a tabletop game environment 10. In this example, the tabletop game environment 10 is a single layer L rather than a modular, or multi-layer $L_{1-n}$, design. The tabletop game environment 10 depicted by FIG. 1B includes a table 100 with a playing surface 102 for a tabletop game 110. Secured to the table 100 is the goal 200. Although the goal 200 is moveable between a first position $P_1$ and a second position $P_2$, FIG. 1B depicts the goal 200 in the first position $P_1$. In the first position $P_1$, the goal 200 may receive the first projectile 20, 20*a* (shown as the proportional hockey puck). Although not depicted, the goal 200 of FIG. 1B may rise to the second position $P_2$ increasing the goal height 200*h* from the playing surface 102. A change in the goal height 200*h* may have several advantages. Some advantages include allowing a user to increase or to decrease the difficulty of the tabletop game 110; enabling the user to play more than one type of tabletop game 110 on a single playing surface 102; and/or permitting the user to use different sized projectiles 20 during the tabletop game 110. For example, the user may increase the difficulty of a tabletop game 110 such as air hockey by positioning the goal 200 barely larger than the projectile 20 (e.g., the first projectile 20, 20*a* depicted as the proportional hockey puck). With the goal 200 barely larger than the proportional hockey puck, the user (or player) may have a limited margin for error when shooting the puck. In other words, the user may only score on a shot of the puck without much wobble (i.e. motion in a plane non-parallel to the playing surface 102). In an opposite respect, the user may increase the goal height 200*h* making the goal 200 a larger target and thus decreasing the difficulty of the tabletop game 110. Additionally or alternatively, the user may change to a larger or a smaller projectile 20 (i.e. a projectile 20 having a greater or lesser height 20*h* from the playing surface 102). For example, the user may modify the tabletop game 110 of air hockey by playing with a second projectile 20, 20*b* (e.g., a ball or a larger hockey puck). Therefore, with the goal 200 being adjustable, the user may adjust the tabletop game 110 to suit his or her needs or abilities during play.

FIG. 1C is another example of the tabletop game environment 10 with the second tabletop game 110, 110*b* seated on top of the first tabletop game 110, 110*a*. In some examples, the second tabletop game 110, 110*b* uses a different projectile 20 from the first tabletop game 110, 110*a*, such that the goal 200 accommodates for the second tabletop game 110, 110*b* by being raised to the second position $P_2$. In some implementations, the different projectile 20 may be the first projectile 20, 20*a* modified (e.g., by size or shape) to form the second projectile 20, 20*b* different from the first projectile 20, 20*a*. The goal 200 in the first position $P_1$ has a height 200$h_1$ and a cross-sectional area $Area_1$ (FIG. 1B); whereas, the goal 200 in the second position $P_2$ has a height 200*h*2 and a cross-sectional area $Area_2$ (FIG. 1C). For example, normally, the goal 200 for a tabletop game 110, of air hockey has a cross-sectional area that is less than the cross-sectional area of the goal 200 for a tabletop game 110 of foosball as a hockey net is typically smaller than a soccer goal. In some examples, the goal 200 may be raised to any intermediate position between the first position $P_1$ and a second position $P_2$ to play the second tabletop game 110, 110*b*. As depicted by FIG. 1C, the second tabletop game 110, 110*b* may share the playing surface 102 with the first tabletop game 110, 110*a* or may have a playing surface 102 independent from the playing surface 102 of the first tabletop game 110, 110*a*. FIG. 1C also illustrates that the second tabletop game 110, 110*b* extends the height of the perimeter sidewall 108 from the playing surface 102.

FIGS. 2A-3C depict examples of the at least one goal 200. The goal 200 includes a net portion 210, at least one bracket 220, and a tray portion 230. The net portion 210 is movable between the first position $P_1$ and the second position $P_2$. The net portion 210 is also configured to receive the first projectile 20, 20*a* in the first position $P_1$ and the second projectile 20, 20*b* in the second position $P_2$. Typically, the net portion 210 faces and aligns with at least one opening 120 to receive the projectile 20 such that the net portion 210 may at least partially encloses the at least one opening 120. In some examples, the table 100 includes more than one goal 200. For example, a first goal 200, 200*a* mounted at a first goal end 104, 104*a* and a second goal 200, 200*b* mounted at a second goal end 104, 104*b*. In these examples, each net portion 210 (e.g., a first net portion 210, 210*a* and a second net portion 210, 210*b*) may face an opposing net portion 210. The net portion 210 has a structure that guides the projectile 20 into the tray portion 230. The structure of the net portion 210 may be any shape to guide the projectile 20 into the tray portion 230, but often the net portion 210 is concave, arcuate, slopped, or straight-walled. Some structures, such as a concave structure, provide the net portion 210 with a greater surface area to reduce momentum of the projectile 20 traveling into the net portion 210 of the goal 200. The reduction of the momentum of the projectile 20 may decrease the likelihood the tray portion 230 fails to contain the projectile 20. Additionally or alternatively, the net portion 210 is constructed from a material that may dampen the momentum of the projectile 20.

Although classically the term "net" may refer to a mesh or a woven fabric, the term "net" for purposes of this disclosure refers to "net" in a broad sense as anything (i.e. any material) serving to capture the projectile 20. Therefore, the net portion 210 may be constructed from any material, as opposed to being limited to a mesh or a woven fabric construction. For example, the net portion 210 may be a moldable material, such as a thermoplastic or a metal, or a less moldable material, such as wood or other composite.

Furthermore, the net portion 210 includes a first end 212, 212*a*, a second end 212, 212*b*, a net top surface 214, and a rear panel 216. The overall structure of the net portion 210 may generally resemble a rectangular prism as illustrated in FIGS. 2A-3C. The rear panel 216 is a portion of the net portion 210 that functions as a backstop to receive the projectile 20. In some examples, the rear panel 216 is concave, arcuate, slopped, or straight-walled to correspond to the structure of the goal 200. In these examples, the goal 200 may more closely resemble a trapezoidal prism than a rectangular prism. The net top surface 214 may be parallel to the playing surface 102 and/or the top surface 106 of the table 100 such that in the first position $P_1$ the top surface 106 may be flush (i.e. coplanar) with the top net surface 214. Although not depicted, the top net surface 214 may alternatively be curved or arcuate. In some examples, a height 210*h* of the net portion 210 (i.e. a net height 210*h*) is equivalent to a space between the top net surface 214 and the playing surface 102. This same space may define a net opening 240 where, in the first position P1, the net opening 240 has a first position height $P_{1h}$ extending between the playing surface 102 and the net top surface 214 and, in the second position $P_2$, the net opening 240 has a second position height $P_{2h}$ extending between the playing surface 102 and the net top surface 214. In these examples, the first position height $P_{1h}$ may be less than the second position height $P_{2h}$. Each of the first end 212, 212*a* and the second end 212, 212*b* may correspond to sides of the net portion 210 that are parallel to the sides 124, 126 of at least one opening 120. In other words, the net portion 210 has a width 210*w* (shown in FIG. 2B) extending between the first end 212, 212*a* and the second end 212, 212*b*. In some examples, the net portion 210 at the first end 212, 212*a* or the second end 212, 212*b* includes at least one flange 218 to engage with a corresponding at least one bracket 220 of the goal 200. In these examples, the at least one flange 218 may extend along the at least one goal end 104 a distance relating to a width 218*w* of the flange 218. In other words, the at least one tab 218 may extend from the at least end 212 of the net portion 210 towards the at least one bracket 220. For example, FIGS. 2A-3A depict the at least one flange 218 as a first flange 218, 218*a* and a second flange 218, 218*b*. Each at least one flange 218 constitutes projections (e.g., rectangular projections) from the first end 212, 212*a* and the second end 212, 212*b*, respectfully, received by a first bracket 220, 220*a* and a second bracket 220, 220*b*.

Generally, a bracket is a component that fixes one part to another part. In the case of the goal 200, the at least one bracket 220 may fix the net portion 210 to the table 100. For example, the at least one bracket 220 may be mounted to the table 100 by fasteners or other fastening means and the net portion 210 of the goal 200 engages with the at least one bracket 220 to also connect the net portion 210 to the table 100 via the at least one bracket 220. The engagement of the at least one bracket 220 to the net portion 210 permits the net portion 210 to move between the first position $P_1$ and the second position $P_2$. In some implementations, the at least one bracket 220 connects the net portion 210 to the table 100 allowing the net portion 210 to move along an axis $A_1$ perpendicular to the playing surface 102 while inhibiting the net portion 210 from moving along an axis $A_2$ parallel to the playing surface 102. In some examples, the tray portion 230, disposed beneath the at least one bracket 220, prevents the net portion 210 from traveling further downward toward the ground plane (i.e. further downward than the first position $P_1$) as the at least one bracket 220 engages with the net portion 210.

Brackets are often defined by their shape or form. Some examples of basic brackets are square brackets (also known as U-brackets), L brackets, S brackets, and sleeve brackets. The at least one bracket 220 of the goal 200 is configured to receive at least one of the first end 212, 212*a* or the second end 212, 212*b* of the net portion 210. In some configurations, the at least one bracket 220 has a channel configured to receive the at least one end 212 of the net portion 210. In some implementations, the at least one bracket 220 is configured to receive both the first end 212, 212*a* and the second end 212, 212*b* of the net portion 210. In some examples, the at least one end 212 of the first end 212, 212*a* or the second end 212, 212*b* received by the at least one bracket 220 is the at least one flange 218 of the net portion 210.

The tray portion 230 is disposed beneath the net portion 210. The tray portion 230 is disposed beneath the net portion 210 in order to receive the first projectile 20, 20*a* and the second projectile 20, 20*b*. The tray portion 230 is configured to store the first projectile 20, 20*a* and the second projectile 20, 20*b*. In some configurations, the goal 200 includes a space S between the tray portion 230 and the net portion 210. The space S between the tray portion 230 the net portion 210 may define a projectile removal opening Ro to remove the first projectile 20, 20*a* and the second projectile 20, 20*b* from the tray portion 230 (shown in FIG. 2B). In some examples, the tray portion 230 includes at least one fastening end 232 where the tray portion 230 may secure to the table 100. The tray portion 230 also may include a top tray surface 234 and at least one sidewall 236. The top tray surface 234 faces the net portion 210. The at least one sidewall 236 extends from the top tray surface 234 toward the net portion 210. The extension of the at least one sidewall 236 defines a lip of a height 236*h* to retain the first projectile 20, 20*a* and the second projectile 20, 20*b* for storage. In some examples, the at least one sidewall 236 forms a perimeter of the tray portion 230. In other examples, the at least one sidewall 236 may be in selective locations of the tray portion 230. Although FIGS. 2A-3C depict the tray portion 230 with a top tray surface 234 that is substantially flat and parallel with the ground plane, the tray portion 230 may be any shape that permits the tray portion 230 to retain the first projectile 20, 20*a* and the second projectile 20, 20*b*.

Each element of the goal 200 (i.e. the net portion 210, the at least one bracket 220, and the tray portion 230) may be independent components or formed together in some combination. For example, the at least one bracket 220 and the tray portion 230 may be formed as a single unit. In other examples, the net portion 210 and the tray portion 230 may be formed as a single unit such that the tray portion 230 is also movable between the first position $P_1$ in the second position $P_2$ along with the net portion 210. As independent or combined components, the elements of the goal 200 may likewise be independently mounted or mounted in combination to the table 100 along the at least one goal end 104.

In some examples, the goal 200 includes a scoreboard 250. The scoreboard 250 refers to any indicator mounted on the goal 200 to convey a score or part of the score of the tabletop game 110. For example, FIGS. 2A-2B and 3A-3B depict the scoreboard 250 as an incremental slider where each increment may convey part of the score of the tabletop game 110. In some examples, the scoreboard 250 may be part of the net portion 210. In these examples, the scoreboard 250 may be mounted or included in a surface of the net portion 210. For example, the scoreboard 250 may be part of any component of the net portion 210, such as the first end 212, 212*a*, the second end 212, 212*b*, the net top surface 214, or the rear panel 216. FIGS. 2A-2B and 3A-3B depict an example where the scoreboard 250 is part of the net top surface 214. In other examples, the scoreboard 250 may be part of tray portion 230. For example, the scoreboard 250 is part of the at least one sidewall 236.

FIG. 2A is an example of the goal 200 from a perspective of an exploded view of the net portion 210. In this example, the at least one bracket 220 and the tray portion 230 secure the goal 200 to the at least one goal end 104 of the table 100. Here, the goal 200 includes two brackets 220, 220*a-b* to receive two flanges 218, 218*a-b* extending from the first end 212, 212*a* and the second end 212, 212*b* respectfully. In this example, each flange 218 slides between the table 100 and each bracket 220 to move between the first position $P_1$ and the second position $P_2$. Referring further to this example, the tray portion 230 is disposed directly beneath each bracket 220 with a pair of end stops 238, 238*a-b* to receive the net portion 210 the first position $P_1$. FIG. 2A depicts the table 100 with the first tabletop game 110, 110*a* and the second tabletop game 110, 110*b* that includes a first opening 120, 120*a* and a second opening 120, 120*b*. Together the first opening 120, 120*a* and the second opening 120, 120*b* span a net opening 240 for the goal 200 to receive the projectile 20 of a height 20*h* less than a height of the net opening 240. In the first position $P_1$, the net portion 210 may partially enclose the net opening 240 for the goal 200. In the second position $P_2$, the net portion 210 substantially encloses the net opening 240.

Figure 2B:
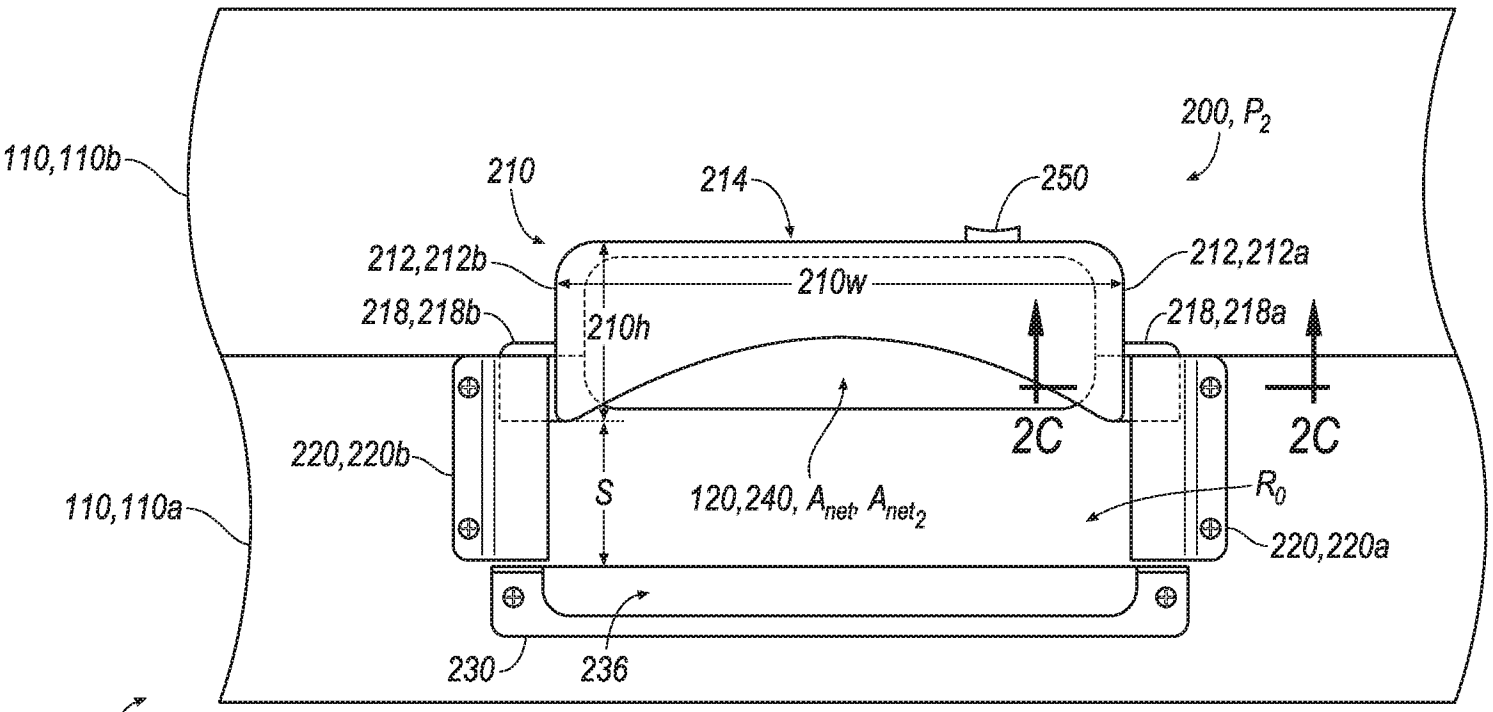
FIG. 2B is a partial front view of an example goal of a tabletop game table.

FIG. 2B is an example of the goal 200 in the second position $P_2$. In the second position $P_2$, the opening 120 formed by the tabletop game 110 may be equivalent to the net opening 240. In some examples, the net opening 240 corresponds to a net cross-sectional area $A_{net}$. In these examples the net cross-sectional area $A_{net}$ is defined by the width 210*w* of the net portion 210 and the net height 210*h*. In some implementations, a first net cross-sectional area Anal in the first position $P_1$ is less than a second net cross-sectional area $A_{net2}$ in the second position $P_2$. In other words, moving the net portion 210 between the first position $P_1$ and the second position $P_2$ alters the net cross-sectional area $A_{net}$ of the net portion 210. In these configurations, the width 210*w* of the net portion 210 stays constant while the net height 210*h* varies. As the net portion 210 moves between the first position $P_1$ and the second position $P_2$, a portion of each flange 218 of the net portion 210 may become exposed from the corresponding at least one bracket 220.

Figure 2C:
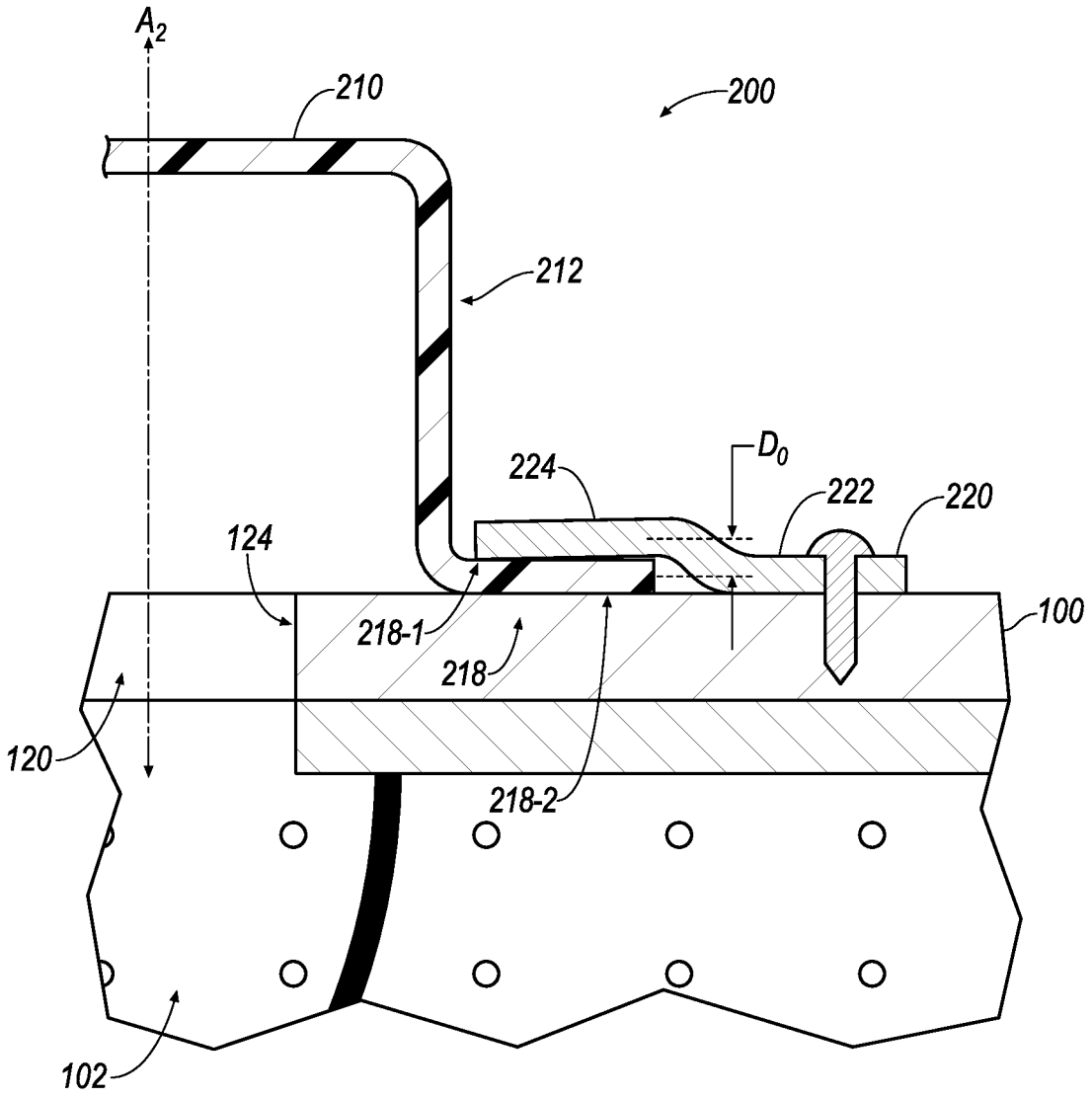
FIG. 2C is a sectional view taken along a line 2C-2C of the example goal of FIG. 2B.

FIG. 2C is a top sectional view along the line 2C of FIG. 2B. FIG. 2C depicts the net portion 210 of the goal 200 engaging with the at least one bracket 220. In some implementations, the at least one flange 218 of the net portion 210 engages with the at least one bracket 220. In some examples, the flange 218 further includes at least one bracket engagement surface 218-1 and a table engagement surface 218-2. In other examples where the goal 200 only engages with the at least one bracket 220 rather than both the at least one bracket 220 and the table 100, the flange 218 includes two bracket engagement surfaces 218-1. The at least one bracket engagement surface 218-1 and/or the table engagement surface 218-2 constrain the net portion 210 to minimal or no movement along the axis $A_2$ parallel to the playing surface 102. In some examples, the at least one bracket 220 includes a fastening portion 222 and an engagement portion 224. In these examples, the fastening portion 222 secures the at least one bracket 220 to the table 100. The fastening portion 222 may secure the at least one bracket 220 to the table 100 by any fastening means, such as screws, bolts, nails, pins, rivets, clips, adhesives, hooks and loops, stitches, snaps, magnets, etc. For example, FIGS. 2C and 3C depict the fastening portion 222 with a lag screw. In some implementations, the engagement portion 224 of the at least one bracket 220 functions as at least one retaining device 260 to secure the net portion 210 in at least one of the first position $P_1$ or the second position $P_2$. For example, the engagement portion 224 is configured to be a friction fit with at least one end 212 of the net portion 210. As depicted by FIGS. 2C and 3C the engagement portion 224 and the fastening portion 222 may be offset by an offset distance $D_O$ such that at least one end 212 of the net portion 210 may fit between the table 100 and the at least one bracket 220. In other words, the offset distance $D_O$ may form a groove or a channel to receive the at least one end 212 and/or the at least one flange 218 of the net portion 210. In other implementations, such as a square bracket, the at least one bracket 220 may have more than one engagement portion 224. In these implementations, the net portion 210 may not directly contact the table 100, but rather the net portion 210 is received between more than one engagement portion 224. Additionally or alternatively, the at least one bracket 220 may have a structure along a length of the at least one bracket 220 to promote engagement between the net portion 210 and the at least one bracket 220. For example, the at least one bracket 220 may be tapered in thickness along the length of the at least one bracket 220. In other examples, the at least one bracket 220 may have grooves or ridges along the length. On the other hand, instead of the at least one bracket 220, the at least one end 212 and/or at least one flange 218 may have a structure to promote engagement between the net portion 210 and the at least one bracket 220.

Figure 3A:
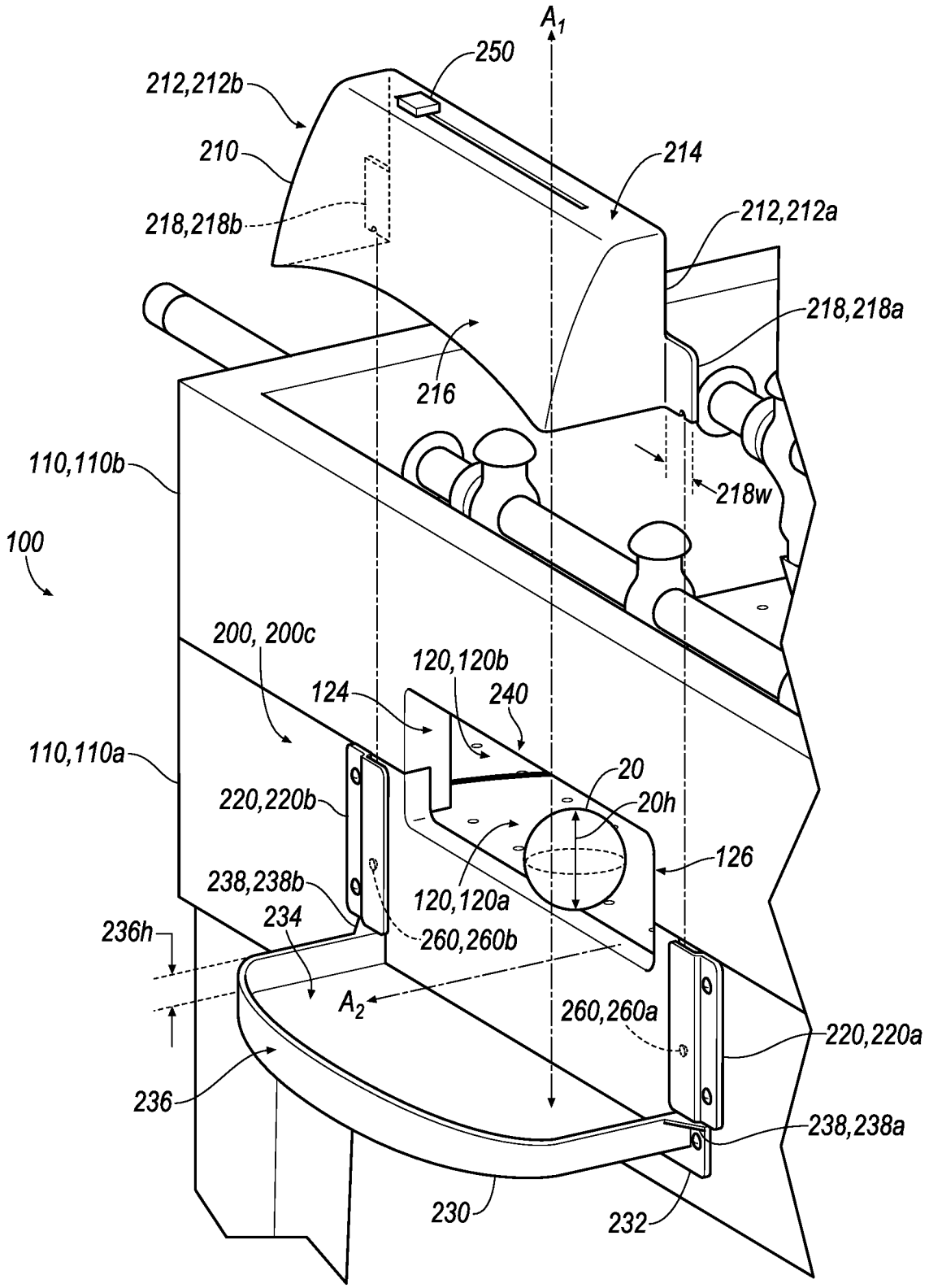
FIG. 3A is an exploded view of an example goal portion of a tabletop game table.
Figure 3B:
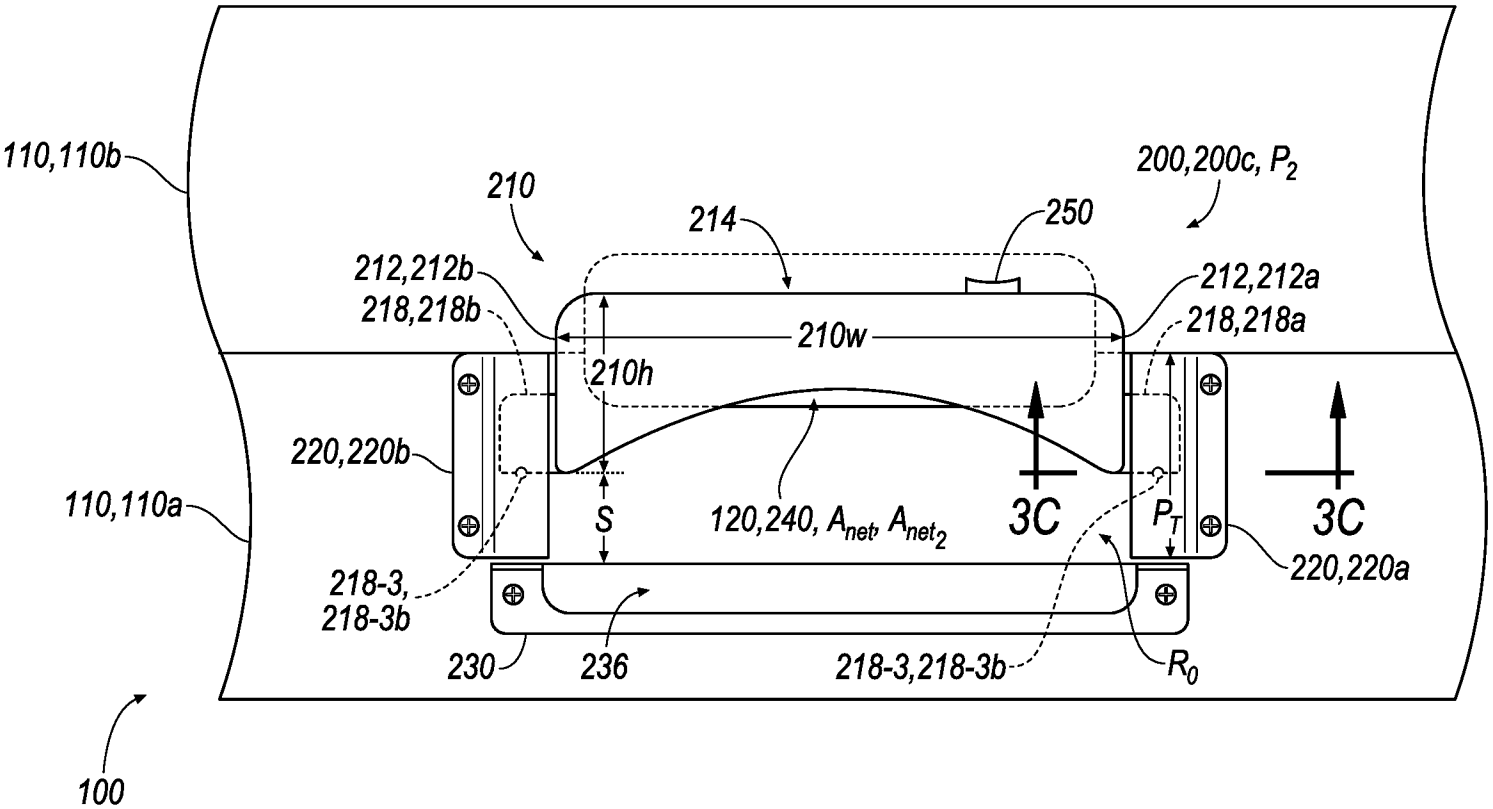
FIG. 3B is a partial front view of an example goal of a tabletop game table.
Figure 3C:
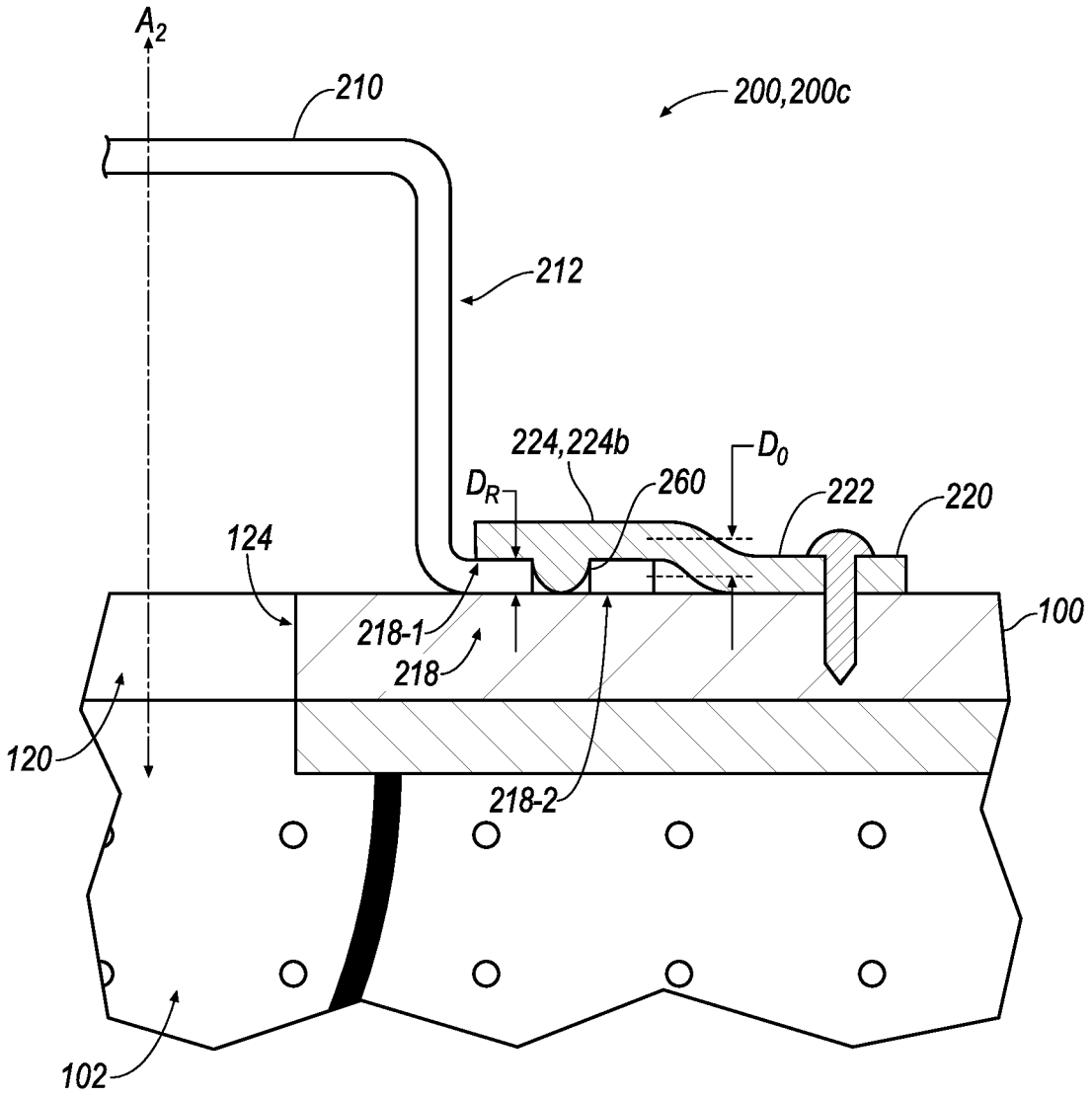
FIG. 3C is a sectional view taken along a line 3C-3C of the example goal of FIG. 3B.

FIGS. 3A-3C illustrate an example where the goal 200 includes at least one retaining device 260 to secure the net portion 210 between at least one of the first position $P_1$ and the second position $P_2$. With the at least one retaining device 260, the goal 200 may maintain position with potentially greater rigidity than without the at least one retaining device 260. This rigidity may be an advantage especially in a tabletop game 110 where the projectile 20 collides with the net portion 210 of the goal 200 with a force having a potential to unsecure a position P of the net portion 210. Another advantage may be that a simple friction fit overtime may wear and cause the net portion 210 to slide more easily out of a desired position. In some examples, the at least one retaining device 260 is a magnet, a mechanical stop, or a friction fit between the net portion 210 and the at least one bracket 220. The retaining device 260 may be part of the net portion 210, the at least one bracket 220, the tray portion 230, or any combination thereof. For example, as previously described above, the tray portion 230 may include the pair of end stops 238, 238*a-b* to receive the net portion 210 the first position $P_1$. FIGS. 2A-B and 3A-B depict the pair of end stops 238, 238*a-b* as a round or a fillet between the at least one fastening end 232 and the at least one sidewall 236. Referring further to the tray portion 230, the tray portion 230 may be positioned such that the at least one sidewall 236 functions as the pair of end stops 238, 238*a-b*. In other implementations, the at least one retaining device 260 may be a combination of features relating to how the at least one bracket 220 is configured to receive the net portion 210. For example, each of the at least one bracket 220 and the net portion 210 may include a magnet. In other examples, the at least one bracket 220 may have a mechanical insert to lock the net portion 210 in place (i.e. prevent travel with the at least one bracket 220).

Referring specifically to FIGS. 3A-3C, the goal 200, 200*c* is similar to the goal 200, 200*a-b* of FIGS. 2A-2C except that the at least one bracket 220 includes the at least one retaining device 260 and the net portion 210 is shaped to receive the at least one retaining device 260 of the at least one bracket 220. As shown by FIG. 3C, in some examples, the at least one retaining device 260 extends from a surface of the engagement portion 224, 224*b* toward the table 100. In some implementations, the net portion 210 may include a shape, such as a groove or a channel, to receive the at least one retaining device 260. For example, FIG. 3B depicts that both flanges 218, 218*a-b* of the at least one flange 218 include an arched cutaway 218-3, 218-3*a-b* to receive a first retaining device 260, 260*a* and a second retaining device 260, 260*b*. In these examples, each retaining device 260, 260*a-b* obstructs and/or limits a path of travel $P_T$ of the net portion 210 within the at least one bracket 220. In some implementations, the at least one retaining device 260 may be temporarily inserted in a position P to limit the path of travel $P_T$ of the net portion 210 or permanently in a position P to limit the path of travel $P_T$ of the net portion 210. FIG. 3C is a sectional view along the line 3C of FIG. 3B and illustrates a retainer device depth DR corresponding to a distance the at least one retaining device 260 extends from the surface of the engagement portion 224, 224*b* toward the table 100.

A number of implementations have been described. Nevertheless, it will be understood that various modifications may be made without departing from the spirit and scope of the disclosure. Accordingly, other implementations are within the scope of the following claims.

What is claimed is:

1. A game table comprising:

a table including a first tabletop game and at least one goal end, the first tabletop game including a first playing surface, a perimeter side wall surrounding the first playing surface, and a goal opening in the perimeter side wall at the at least one goal end of the table; and a goal secured to the at least one goal end at the goal opening of the first tabletop game and including:

a net portion with a first end, a second end, a top net surface, and a rear panel, the net portion including a projectile receiving opening opposite the rear panel and adjacent the top net surface, the projectile receiving opening formed by edges of the first end, the second end, and the top net surface, the projectile receiving opening enclosing and defining a boundary of the goal opening as the net portion moves between a first position and a second position, wherein the projectile receiving opening is configured to receive a first projectile in the first position and a second projectile in the second position;

at least one bracket secured to the at least one goal end of the table and including a retention device, the at least one bracket configured to receive at least one of the first end or the second end of the net portion, the retention device of the at least one bracket vertically securing the net portion in the first position defining a first cross sectional area of the projectile receiving opening and in the second position defining a second cross sectional area of the projectile receiving opening, each of the first cross sectional area and the second cross sectional area of the projectile receiving opening defined by a vertical height extending from the first playing surface to the top net surface and a width from the first end to the second end; and a tray portion disposed beneath the net portion, the tray portion configured to store the first projectile and the second projectile, wherein the first position of the net portion is at a first height from the tray portion and the second position of the net portion is at a second height from the tray portion, the second height greater than the first height.

2. The game table of claim 1, wherein the at least one bracket includes an engagement surface and the retention device is configured to vertically secure the net portion in the first position or the second position in abutment between the goal end of the table and the engagement surface of the at least one bracket.

3. The game table of claim 1, wherein the edges of the first end, the second end, and the top net surface that form the projectile receiving opening are coplanar.

4. The game table of claim 1, wherein the net portion adjusts from the first height to the second height by traveling along a surface of the at least one goal end of the table.

5. The game table of claim 1, wherein the retention device projects from a surface within a channel of the at least one bracket, the net portion adjustable between the first position and the second position by moving along the channel of the at least one bracket.

6. A game table comprising:

a table including a first tabletop game, a second tabletop game, and at least one goal end, the first tabletop game including a first playing surface, a first boundary wall at the at least one goal end of the table, and a first portion of a goal opening in the first boundary wall, the second tabletop game disposed on the first tabletop game and including a second boundary wall and a second portion of the goal opening in the second boundary wall aligned with the first portion of the goal opening in the first boundary wall at the at least one goal end of the table; and a goal secured to the at least one goal end at the goal opening of the first tabletop table and the second tabletop game and including:

a net portion with a first end, a second end, and a top net surface, the net portion moveable between a first position and a second position, the net portion defined by a net opening configured to receive a first projectile in the first position and a second projectile in the second position;

at least one bracket secured to the at least one goal end of the table and including a retention device, the at least one bracket configured to receive at least one of the first end or the second end of the net portion, the retention device of the at least one bracket vertically securing the net portion in the first position and the second position, the first position defined by a first cross sectional area of the net opening extending a first vertical height from the first playing surface to the top net surface and a width from the first end to the second end, the second position defined by a second cross sectional area of the net opening extending a second vertical height from the first playing surface to the top net surface and the width from the first end to the second end; and a tray portion disposed beneath the net portion, the tray portion configured to store the first projectile and the second projectile, wherein the first position of the net portion is at a first height from the tray portion and the second position of the net portion is at a second height from the tray portion, the second height greater than the first height.

7. The game table of claim 6, wherein the first boundary wall surrounds the first playing surface, the first boundary wall comprising a first wall end and a second wall end, wherein the first wall end, the second wall end, and the first playing surface at the at least one goal end collectively forming the first portion of the goal opening.

8. The game table of claim 7, wherein the second boundary wall is matingly disposed on the first boundary wall, and wherein the disposition of the second boundary wall on the first boundary wall mates the first portion of the goal opening with the second portion of the goal opening collectively forming an entirety of the goal opening.

9. The game table of claim 8, wherein, in the second position, the net portion substantially encloses the goal opening.

10. The game table of claim 6, wherein the first tabletop game is air hockey and the second tabletop game is foosball.

11. The game table of claim 6, wherein the second tabletop game is removeably disposed on the first tabletop game.

* * * * *